United States Patent [19]

Gates, Jr. et al.

[11] 4,401,093

[45] Aug. 30, 1983

[54] OIL FILL/AIR BREATHER CAP WITH INTEGRAL OIL SEPARATOR

[75] Inventors: Freeman C. Gates, Jr., Southfield; Egils A. Purins, Plymouth, both of Mich.

[73] Assignee: Ford Motor Company, Dearborn, Mich.

[21] Appl. No.: 386,565

[22] Filed: Jun. 9, 1982

[51] Int. Cl.[3] ..... F01M 13/00

[52] U.S. Cl. ..... 123/573; 123/572; 55/385 C; 55/DIG. 19; 55/320; 55/498

[58] Field of Search ..... 55/320, 321, 498, 502, 55/385 C, DIG. 19; 123/572, 573, 195 C, 198 E, 41.86; 220/371, 373

[56] References Cited

U.S. PATENT DOCUMENTS

| | | | |
|---|---|---|---|
| 3,546,853 | 12/1970 | Claar | 55/498 |
| 4,020,970 | 3/1977 | Koscik et al. . | |
| 4,169,432 | 10/1979 | White . | |
| 4,267,941 | 5/1981 | Loudin . | |
| 4,271,977 | 6/1981 | Saigne | 55/385 C |

*Primary Examiner*—Bernard Nozick

*Attorney, Agent, or Firm*—Robert E. McCollum; Clifford L. Sadler

[57] ABSTRACT

A one-piece combination oil fill/air breather cap for an automotive type engine positive crankcase ventilation (PCV) system that includes a filter and oil separator chambers below the filter defined by partitions or baffles upon which the oil droplets impinge during reverse flow operation of the PCV system; a double lip flared annular seal operating in tension being sandwiched between the cap lower surface and the engine rocker arm cover to minimize oil leakage.

5 Claims, 7 Drawing Figures

OIL FILL/AIR BREATHER CAP WITH INTEGRAL OIL SEPARATOR

This invention relates in general to a combination oil fill/air breather cap for an automotive type internal combustion engine. More particularly, it relates to a one-piece cap that includes a filter and oil separator means to minimize loading of the filter upon backflow of the crankcase oil vapors to the air cleaner.

Combination oil fill/air breather crankcase ventilation caps are known. For example, U.S. Pat. No. 4,169,432, White, shows an oil fill cap integrated with a positive crankcase ventilation (PCV) valve assembly and a filter element to normally control the flow of crankcase vapors into the engine, or to the air cleaner on pushover or backflow. No oil separator means integral with the cap is provided, nor are the various parts an integral one-piece assembly. Furthermore, the seal between the engine and filler cap is of the simple O ring type.

U.S. Pat. No. 4,020,970, Koscik et al, and U.S. Pat. No. 4,267,941, Loudin, are other examples of one-piece plastic combination oil fill/breather cap constructions. In Koscik, the annular flared seal 36 is also plastic and may leak, especially if the stackup of tolerances between the engine valve cover and the seal are a maximum. Also, the cap does not include a filter element nor an integral oil separator baffle means to restrict passage of oil droplets into the air cleaner during backflow conditions. Loudin shows a one-piece plastic member with a plastic double lip seal of the flared type. Under conditions of maximum stackup of tolerances due to various engine configurations, this plastic seal tends to encourage oil leakage. Also, it requires an annular ridge in the clearance space between the lip seals, and the assembly does not include integral oil separator means.

U.S. Pat. No. 3,313,281, Schneider, shows a combination oil fill/air breather construction employing an air filter sealable upon an oil filler tube. No oil separator means integral with the assembly is provided, the cap is not integral with the oil filler tube, and there is no positive seal means between the cap and wall of the engine portion defining the oil fill opening.

Other constructions that are known include combination oil fill/air breather caps connected to the air cleaner with an air filter in the line rather than integral with the cap. In this case, the filter and tube must be carefully aligned in an essentially vertical attitude to allow drainback of any oil collected on the filter. This type of construction requires constant attention to maintain the filter in the proper attitude. It further does not completely seal the leakage of crankcase vapors from around the base of the cap, and no oil separator means is formed integral with the cap.

The invention provides a one-piece oil fill/air breather cap containing a filter and oil separator means and including double lip seal means between the cap and the engine portion to which it is attached for positively preventing oil leakage at this location. The assembly consists of a hollow housing containing an annular filter with a tube extending from one side of the filter toward the engine air cleaner and a closed end cylindrical portion extending from the opposite side of the filter toward the engine. The cylindrical portion includes a plurality of oil separator chambers defined by partitions against which the oil in the crankcase vapors impinge during backflow or pushover operation, which thereby minimizes loading of the filter.

It is a primary object of the invention, therefore, to provide a one-piece combination oil fill/air breather cap having an air filter and oil separator means integral therewith.

It is a further object of the invention to provide in connection with the above assembly an annular flared type double lip seal operable in tension and sandwiched between the filter and the engine part to which it is assembled for minimizing the leakage of oil vapors.

Other objects, features and advantages of the invention will become more apparent upon reference to the succeeding detailed description thereof, and to the drawings illustrating the preferred embodiment thereof; wherein, FIG. 1 is a side elevational view of a combination oil fill/air breather cap embodying the invention assembled to an internal combustion engine;

Figure 1:
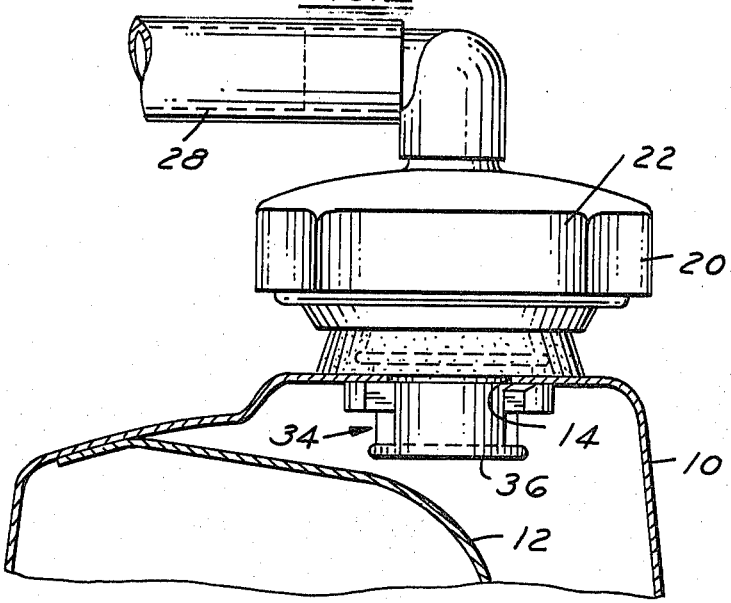
Figure 2:
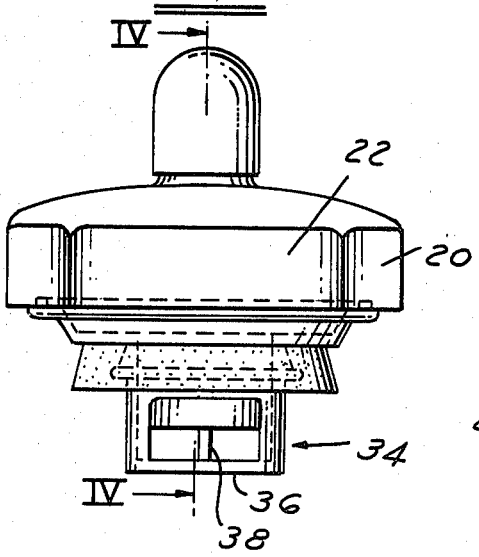
FIG. 2 is a view similar to FIG. 1 rotated 90 degrees.
Figure 3:
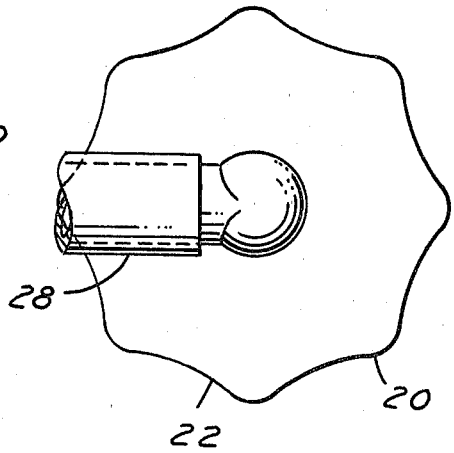
FIG. 3 is a top view of the FIG. 1 showing.

As stated above, the invention is intended for use with an automotive type internal combustion engine positive crankcase ventilation (PCV) system to combine the functions of adding oil to the engine and controlling the flow of crankcase vapors to and from the engine. For this purpose, FIG. 1 shows a portion of an engine rocker arm cover 10 with internal baffle means 12 and an aperture or opening 14 for adding oil to the engine in the usual manner. The opening 14 in this case is adapted to receive the lower end of the combination oil fill/air breather cap assembly embodying the invention.

Figure 4:
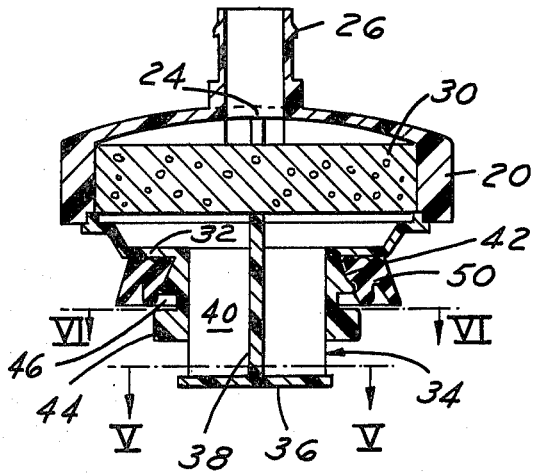
FIG. 4 is a cross-sectional view taken on a plane indicated by and viewed in the direction of the arrows IV—IV of FIG. 2.

More particularly, as more clearly shown in FIGS. 1-4, the assembly includes a hollow annular housing 20 having essentially an octagonal shape (FIG. 3) with vertical serrations 22 (FIG. 2) on its outer periphery to provide a twist grip handle type housing. The upper (as seen in FIG. 4) surface of housing 20 is formed with a central or axial opening 24 that is axially aligned with a nipple type adapter 26 formed integral therewith. A plastic corrugated flexible tube 28 (FIG. 1) is pushed over nipple 26 at one end and adapted to be connected at its other end to the conventional engine air cleaner (not shown).

Figure 5:
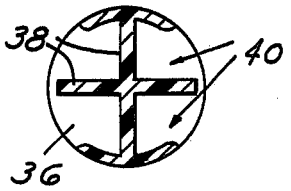
FIGS. 5 and 6 are cross-sectional view taken on planes indicated by and viewed in the direction of the arrows V—V and VI—VI of FIG. 4; and, FIG. 7 is a perspective view on a reduced scale of the combination oil fill/air breather cap assembly shown in FIG. 1.
Figure 6:
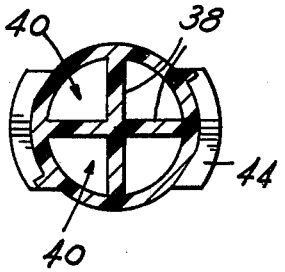
Figure 7:
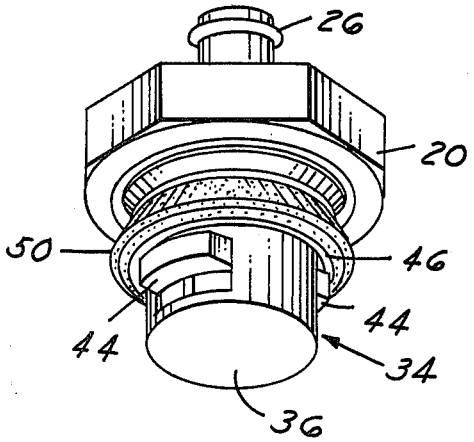

The largest diametrical portion of housing 20 contains an annular disc type filter element 30. The housing is formed on the lower or engine side of the filter with a stepped diameter wall 32 defining a cylindrical tube portion 34 closed at its lower end 36. A number, two in this case, of vertically extending partitions 38 extend from the bottom or closed end 36 to a point adjacent the lower side of filter 30 and at right angles to one another, as best seen in FIGS. 5 and 6. Together with the wall of the cylindrical tube 34, they define four oil separator chambers 40. The partitions 38 constitute baffles against which the oil droplets impinge during pushover or reverse flow of the crankcase oil laden vapors when the crankcase becomes pressurized above the atmospheric pressure level.

The outer perimeter of lower portion 34 is formed with a pair of retaining flanges 44 on diametrically opposite sides of tube 34. The flanges 44 constitute the lower part of a known type of bayonet connection between the wall of rocker arm cover 10 defining aperture 14 and the combination oil fill/air breather cap base. Although not shown, opening 14 would include two conventional diametrically opposite slots in the annulus adapted to be mated with the laterally projecting flanges 44 on the cap in a known manner to permit insert of the cap base through the opening. Subsequent rotation of the cap 90° would align the slots 46 (FIG. 4) formed between the flanges and the outer flared surface of tube 34 with the wall of cover 10 to wedge the two together with the flanges 44 against the underside of the cover.

The upper portion 42 of tube 34 is flared to receive an annular double lip rubber seal 50. The latter projects downwardly to overlap the major portion of the slots 46 to provide a positive seal against the outer surface of rocker arm cover 10 when assembled to it. More specifically, the outward flaring of the seal will place the seal in tension upon assembly of the cap to the rocker arm cover, thereby constituting the seal as a preload spring as well as urging the cap more positively against the inner surface of the rocker arm cover. The flared design absorbs the tolerance stackup between cover 10 and the housing in contrast to a vertically arranged seal member which tends to buckle and thereby permit oil leakage in the event of a high tolerance stackup. The double lip design with the annular clearance space between provides a labyrinthian path for leakage of oil outwardly.

The operation is believed to be clear from the above description and a consideration of the drawings, and, thereof, will not be given in detail. Suffice it to say that during normal operation of the engine, the PCV system, which is connected to the manifold, normally will be at subatmospheric pressure conditions. Therefore, an induction of clean air will flow from the air cleaner through inlet tube 26 past air filter 30, and into and through the oil separation chambers 40 and out to the crankcase through the open side apertures 41. When the engine load conditions change so that the crankcase becomes pressurized, a pushover or reverse flow condition then can take place. The oil laden crankcase vapors then flow in a reverse direction from the cover 10 through the oil fill/air breather cap assembly back into the air cleaner. In doing so, the oil vapors pass into the oil separator chambers 40 causing the oil droplets to impinge on the partition walls 38 and thereby separate from the air, which then flows through the filter 30 and into the air cleaner proper. Subsequently, when pressure conditions change, the collection of oil in the oil separator chambers will drain back into the crankcase.

Removal of the cap is accomplished by grasping the octagonally shaped surface of housing 20 and rotating it 90° to align flanges 44 with the mating openings in the valve cover 10 to permit a withdrawal of the assembly cap. Reinsertion of the cap into the rocker arm cover and rotating it 90° will then sandwich the flared annular seal 50 between the housing and the cover and tension the seal to more positively prevent the leakage of oil out from the assembly.

From the foregoing, it will be seen that the invention provides a one-piece combination oil fill/air breather cap assembly that includes integral therewith an oil filter and oil separator means, and further includes a flared type annular seal to minimize oil leakage from the engine.

While the invention has been shown and described in its preferred embodiment, it will be clear to those skilled in the arts to which it pertains that many changes and modifications may be made thereto without departing from the scope of the invention.

We claim:

1. An oil fill/air breather cap for use with an automotive type internal combustion engine having an air cleaner comprising:

a hollow one-piece closed housing adapted to be inserted into an opening of an engine through which oil and air may be added and through which oil laden crankcase vapors from the engine may flow in a reverse direction out of the engine toward the air cleaner, the housing containing an oil filter and oil separator means on the engine side of the filter in axial alignment therewith, the oil separator means having baffle means inhibiting the flow of oil droplets from the crankcase to the filter, and tube means connecting the housing on the air cleaner side of the filter to the air cleaner for the normal flow of clean air from the air cleaner through the filter and oil separator to the crankcase.

2. A cap as in claim 1, including bayonet type connecting means between the cap and engine wall portion defining the opening for locking the cap to the wall portion, and seal means between the housing and the engine wall portion having a flared outer periphery operable in tension to preload the cap against the wall portion upon assembly of the two.

3. A cap as in claim 2, the lower portion of the housing including a cylindrical portion open at its upper end to the filter and closed at its lower end, a plurality of partitions extending from the closed end to the filter and at right angles to each other and together with the cylindrical wall defining a plurality of oil separator chambers, and a plurality of openings diametrically opposite each other through the side wall of the cylindrical portion adjacent the lower end for the movement of air in one direction through the housing and chambers and openings toward the crankcase and the movement of crankcase oil and vapors in the opposite direction through the plurality of chambers to impinge the oil droplets on the partitions to separate the oil from the vapors.

4. A cap as in claim 3, including slot means projecting laterally from opposite sides of the cylindrical portion for cooperation with the edge of the wall portion defining the opening for securing the cap housing to the wall portion.

5. A cap as in claims 3 or 4, the seal means comprising a double lip annular rubber member with an annular space therebetween, the seal member being sandwiched between the housing and engine wall portion upon insertion of the cap into the opening.

* * * * *